US012414663B1

(12) United States Patent
Ragner et al.

(10) Patent No.: US 12,414,663 B1
(45) Date of Patent: Sep. 16, 2025

(54) VACUUM HOSE ADAPTOR

(71) Applicants: Gary Ragner, Gainesville, FL (US); Robert Daniel de Rochemont, Jr., Gainesville, FL (US)

(72) Inventors: Gary Ragner, Gainesville, FL (US); Robert Daniel de Rochemont, Jr., Gainesville, FL (US)

( * ) Notice: Subject to any disclaimer, the term of this patent is extended or adjusted under 35 U.S.C. 154(b) by 2 days.

(21) Appl. No.: 18/527,740

(22) Filed: Dec. 4, 2023

Related U.S. Application Data

(60) Provisional application No. 63/437,643, filed on Jan. 7, 2023.

(51) Int. Cl.
*A47L 9/24* (2006.01)

(52) U.S. Cl.
CPC ..... *A47L 9/242* (2013.01); *A47L 9/244* (2013.01)

(58) Field of Classification Search
CPC . A47L 9/24; A47L 9/242; A47L 9/248; A47L 9/244; A47L 9/02
USPC ..... 285/7; 15/338
See application file for complete search history.

(56) References Cited

U.S. PATENT DOCUMENTS

| | | | |
|---|---|---|---|
| 1,021,731 | A | 3/1912 | Spangler |
| 1,648,466 | A | 11/1927 | Solliday |
| 1,703,863 | A | 3/1929 | Allen |
| 1,708,282 | A | 4/1929 | Serva |
| 1,920,621 | A | 8/1933 | Allen |
| 2,871,504 | A | 2/1959 | Gall et al. |
| 2,996,748 | A | 8/1961 | Gitzendanner |
| 4,008,505 | A | 2/1977 | Clowers |
| 4,357,177 | A | 11/1982 | Knox |

FOREIGN PATENT DOCUMENTS

| | | |
|---|---|---|
| DE | 375368 C | 5/1923 |

*Primary Examiner* — David Bochna

(57) ABSTRACT

A vacuum hose adaptor (20) having a suction air channel (24) defined between a sealing plate (25) and a male hose coupler (22). The sealing plate (25) is designed to make a relatively air tight seal against the bottom plate (58) (i.e., rotary brush opening, suction inlet) on the bottom of a main nozzle (55) on an upright vacuum cleaner (50) and may use one or more locking mechanisms (26) for temporarily holding the sealing plate (25) against the bottom plate (58) of the main nozzle (55). A vacuum hose (60) can be removably attached to the male hose coupler (22) so that suction air produced by the upright vacuum cleaner (50) can be conducted from the upright vacuum cleaner (50) through the main nozzle (55), through the suction air channel (24), through the male hose coupler (22) and through the vacuum hose (60) for use.

16 Claims, 4 Drawing Sheets

VACUUM HOSE ADAPTOR

CROSS REFERENCE TO RELATED APPLICATIONS

This Application claims priority from U.S. Provisional Application 63/437,643 filed on Jan. 7, 2023 and is hereby incorporated by reference in its entirety, including any figures, tables, equations or drawings.

BACKGROUND

The present disclosure is related to vacuum cleaner accessories, and more specifically vacuum accessories that attach over the 'roller brush' opening of an upright vacuum cleaner to allow attachment of a vacuum hose to the vacuum cleaner.

Since the dawn of time, man has strived to invent things to improve his surroundings and make life better. The broom was invented over 4,000 years ago to help make a residence cleaner and more appealing to live in. In the $19^{th}$ century, mechanical rolling sweeping devices were invented to whisk debris directly into a containment tray. Then the final evolution was when suction was added first by hand bellows, then finally gas powered motor and then evolved with smaller portable electric motors initially called 'Electric Suction Sweepers', then later, the term 'Vacuum Cleaner'. Once a tool for the affluent, it steadily became more affordable for the average household post-World War II. Over the years vacuums have become easier to use and many labor saving attachments were invented enabling the user to clean and maintain a variety of both hard and non-hard surfaces. Certain brands of known upright vacuum cleaners, for example the Kirby brand, have attachments that offer great versatility for the user. However, conversion from an upright carpet/rug mode to hose functions has been noticeably less convenient, with the hose conversion typically requiring no less than 10 steps to transition to full hose operation and back again to the upright carpet/rug vacuuming mode (upright mode).

The vacuum hose adaptor presented herein greatly simplifies the conversion process with only two steps to convert to hose operation and two more steps to return to upright operation. This saves a noticeable amount of time and labor because many of the steps removed from the current configuration are labor intensive. The labor intensive steps eliminated include: 1) twisting the belt lifter to pull the belt away from the main nozzle, 2) releasing the clamp on the main nozzle, 3) lifting the main nozzle away from the vacuum and placing it out of the way, 4) connecting the hose to the vacuum and 5) then locking it in place with the clamp. To return to upright mode, these steps can be done in reverse. The presently disclosed vacuum hose adaptor requires only two steps: 1) slipping the hose adaptor into place, and 2) flipping the actuator tab to lock the vacuum hose adaptor in place. To return to upright mode these two steps can be done in reverse. Besides decreasing the work needed for converting back and forth between modes, the disclosed vacuum hose adaptor also provides a much more stable base for rolling. This allows the user to pull the vacuum hose from nearly any direction while reducing the danger that the main vacuum will accidently fall over.

SUMMARY

The disclosed vacuum hose adaptor allows a more rapid and less labor intensive transition between an upright vacuuming mode and a hose cleaning mode of an upright vacuum cleaner. The disclosed vacuum hose adaptor can comprise a housing body, a pair of swivel wheels mounted to the housing body, a locking mechanism, a pivotal arm assembly and a male hose coupler. Housing body can comprise a suction air passageway that extends between a sealing surface defined on the housing body and the male hose coupler. The sealing surface can include a rubber or foam gasket that is designed to seal against the suction inlet on a vacuum cleaner agitator (i.e., bottom plate). This transfers the suction air to the male coupler which is adapted for attachment of a vacuum hose. The swivel wheels are mounted to the bottom of the housing of the connector at an angle so that their pivotal axis of the swivel wheels are substantially perpendicular to the floor surface when mounted to the upright vacuum (e.g., an upright vacuums may be angled back at about 15 degrees due to the height of the disclosed vacuum hose adaptor mounted beneath it). The wide spacing of the pair of swivel wheels provide greater stability for the vacuum when being pulled around by the attached vacuum hose. The vacuum hose can remain attached to the disclosed vacuum hose adaptor when removed from the upright vacuum (i.e., in upright/carpet mode) to saving time when switching between modes.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DRAWING REFERENCE NUMBERS

Figures 1A, 1B:
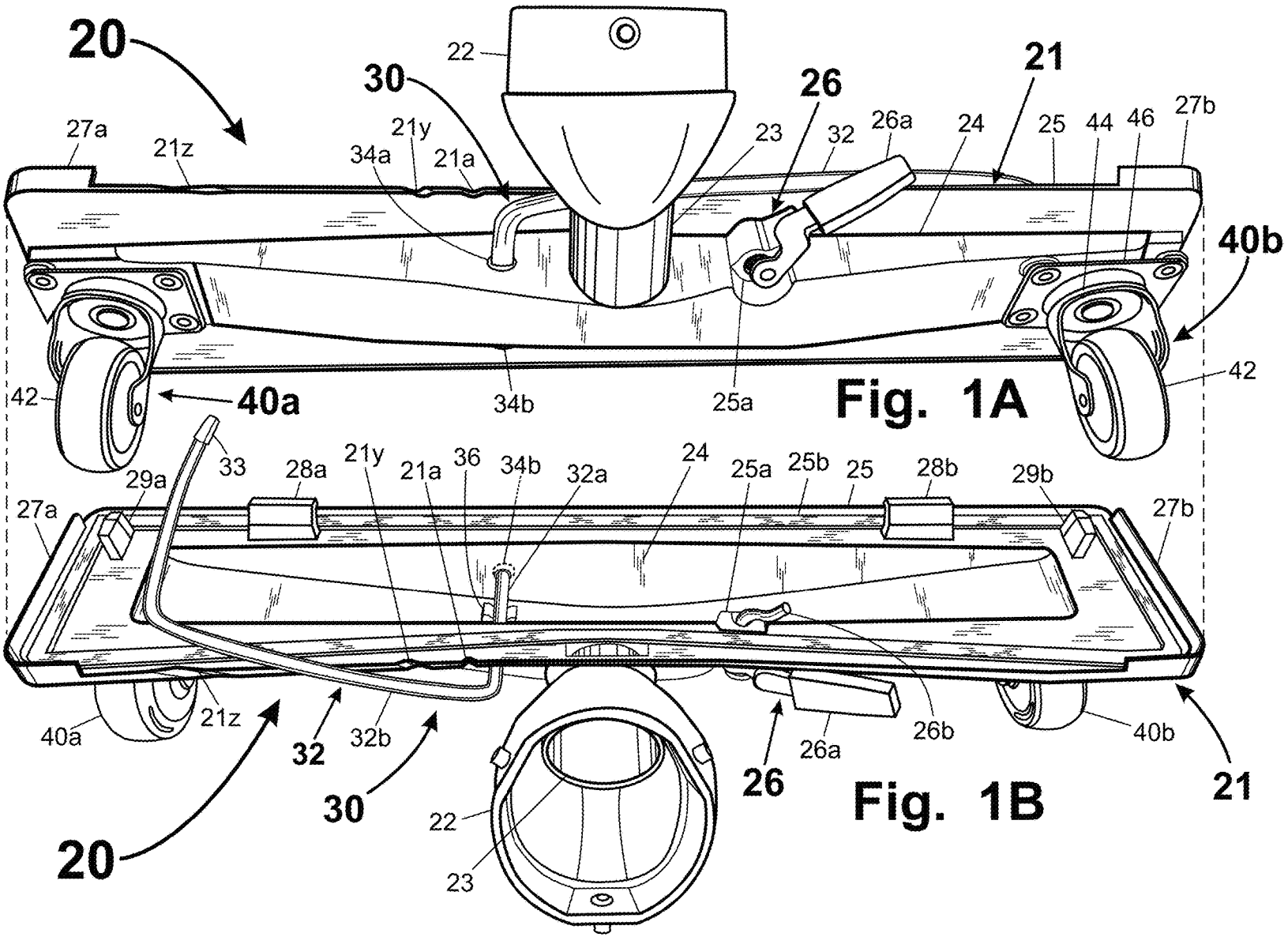
FIG. 1A are a bottom/front perspective schematic illustration of the disclosed vacuum hose adaptor. The pivotal arm assembly in a stowed position.
FIG. 1B are a top/front perspective schematic illustration of the disclosed vacuum hose adaptor. The pivotal arm assembly in a stowed position.

| | |
|---|---|
| 20 Vacuum Hose Adaptor | 21a Securing Indent (High-speed operation) |
| 21 Adaptor body | 21z Securing Indent (stowage) |
| 21y Securing Indent (Low-speed operation) | 23 Air passageway (front surface) |
| 22 Male hose coupler | 24a-b Pivot holes for Pivot arm 32 |
| 24 Suction air channel | 25a Pivotal support (locking mechanism 26) |
| 25 Sealing plate (seals against the roller | 26 Locking mechanism |

-continued

| DRAWING REFERENCE NUMBERS | |
|---|---|
| brush suction inlet at the bottom plate 58) | 26b Locking pin for Locking mechanism |
| 25b Sealing gasket | 27b Right exterior guide |
| 26a Actuator Tab (locking mechanism) | 28b Right attachment bracket |
| 27a Left exterior guide | 29b Right internal guide |
| 28a Left attachment bracket | |
| 29a Left internal guide | |
| 30 Pivotal arm assembly | 32 Pivotal arm |
| 32a Pivotal axis section of arm 32 (Horiz.) | 32b Contact section of arm 32 (vertical) |
| 32c Extended section of arm 32 (Horizontal) | 32y Low-speed position |
| 32y Stowed position | 33 Soft tip of arm 32 |
| 34a Back stop (back C-ring) | 34b Front stop (front C-ring) |
| 36 Friction block | |
| 40a Left swivel wheel assembly | 40b Left swivel wheel assembly |
| 42 Wheels | 44 Swivel bearing |
| 46 Swivel plate (angled) | 49 Lean angle |
| 50 Upright vacuum cleaner | 51 Main Body (vacuum 50) |
| 52 Headlight cap assembly (in up position) | 53 High-speed switch (high/low switch) |
| 54 Clamp | 55 Main nozzle |
| 57 Belt lifter | 58 Bottom plate (Main nozzle 56) |
| 60 Vacuum hose (i.e. for upright vacuum) | 62a Activator arm (i.e. for button 53) |
| 62 Female hose coupling | |
| 64 Vacuum hose conduit (hose section of 60) | |

DETAILED DESCRIPTION

Figure 2:
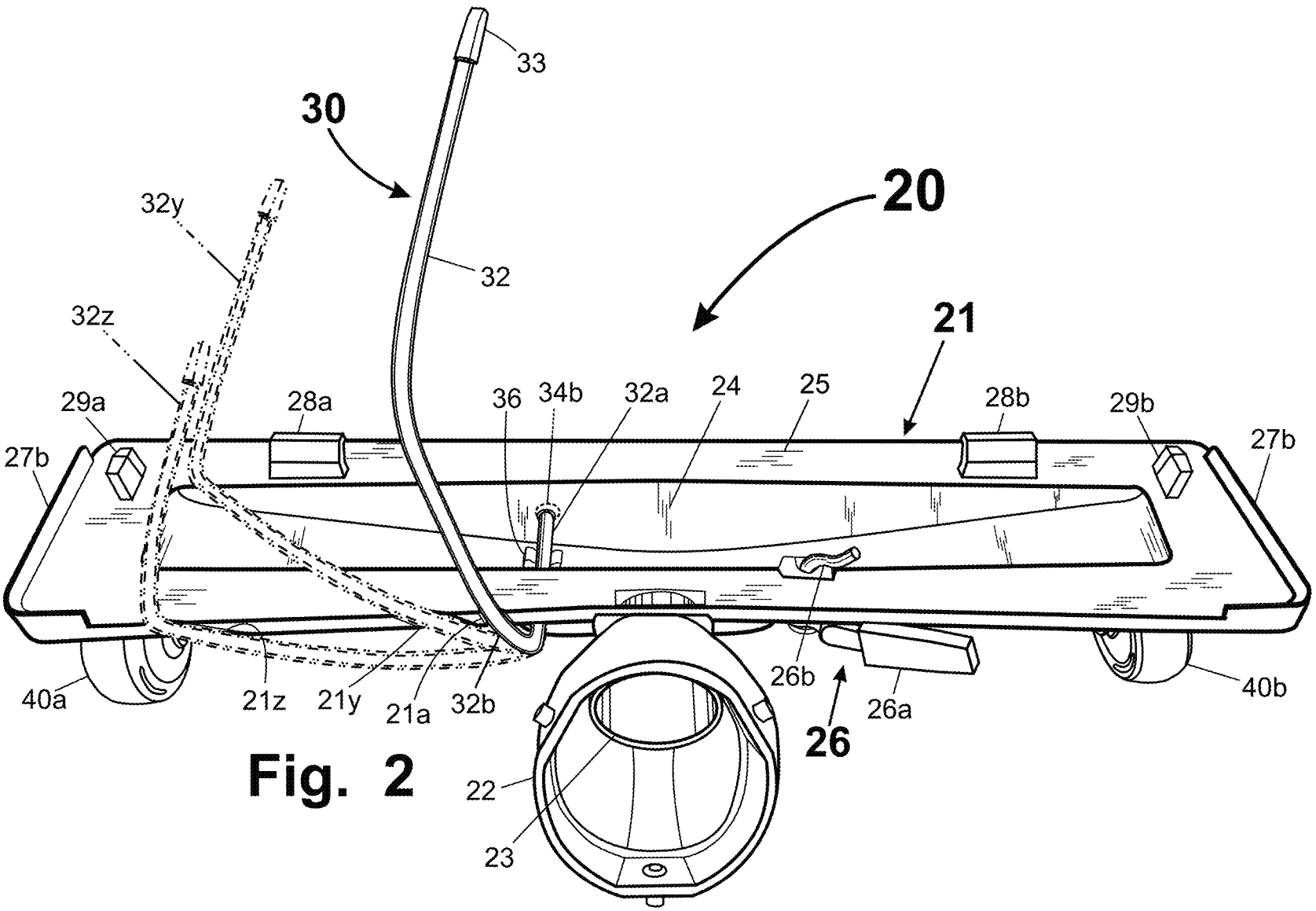
FIG. 2 is a perspective top/rear schematic illustration of the disclosed vacuum hose adaptor showing its pivotal arm assembly in its operational position with solid lines, and one of its stowed positions with shadow lines.
Figure 3:
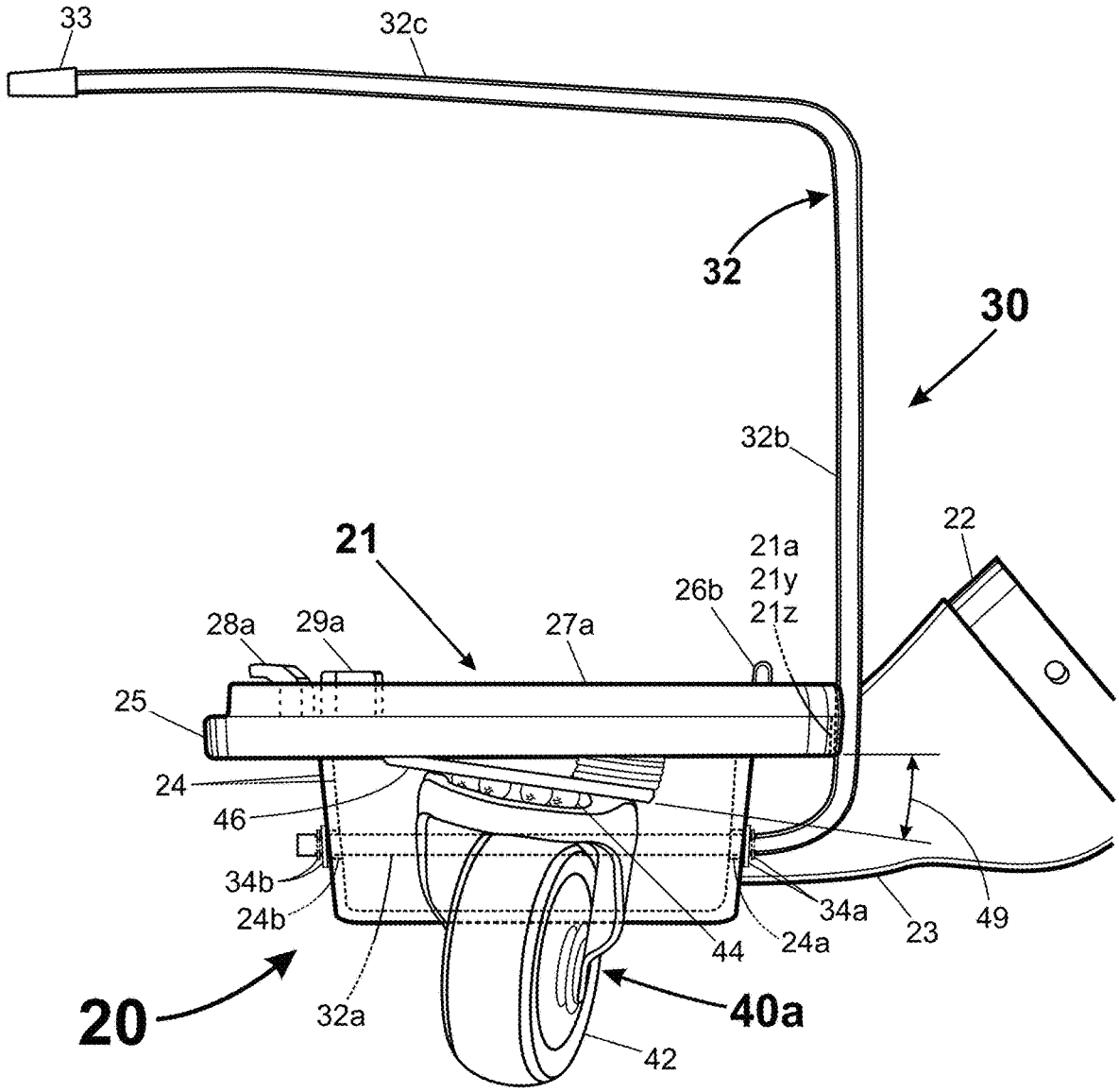
FIG. 3 is a left-side schematic illustration of the disclosed vacuum hose adaptor with its pivotal arm in its operational position.
Figure 4:
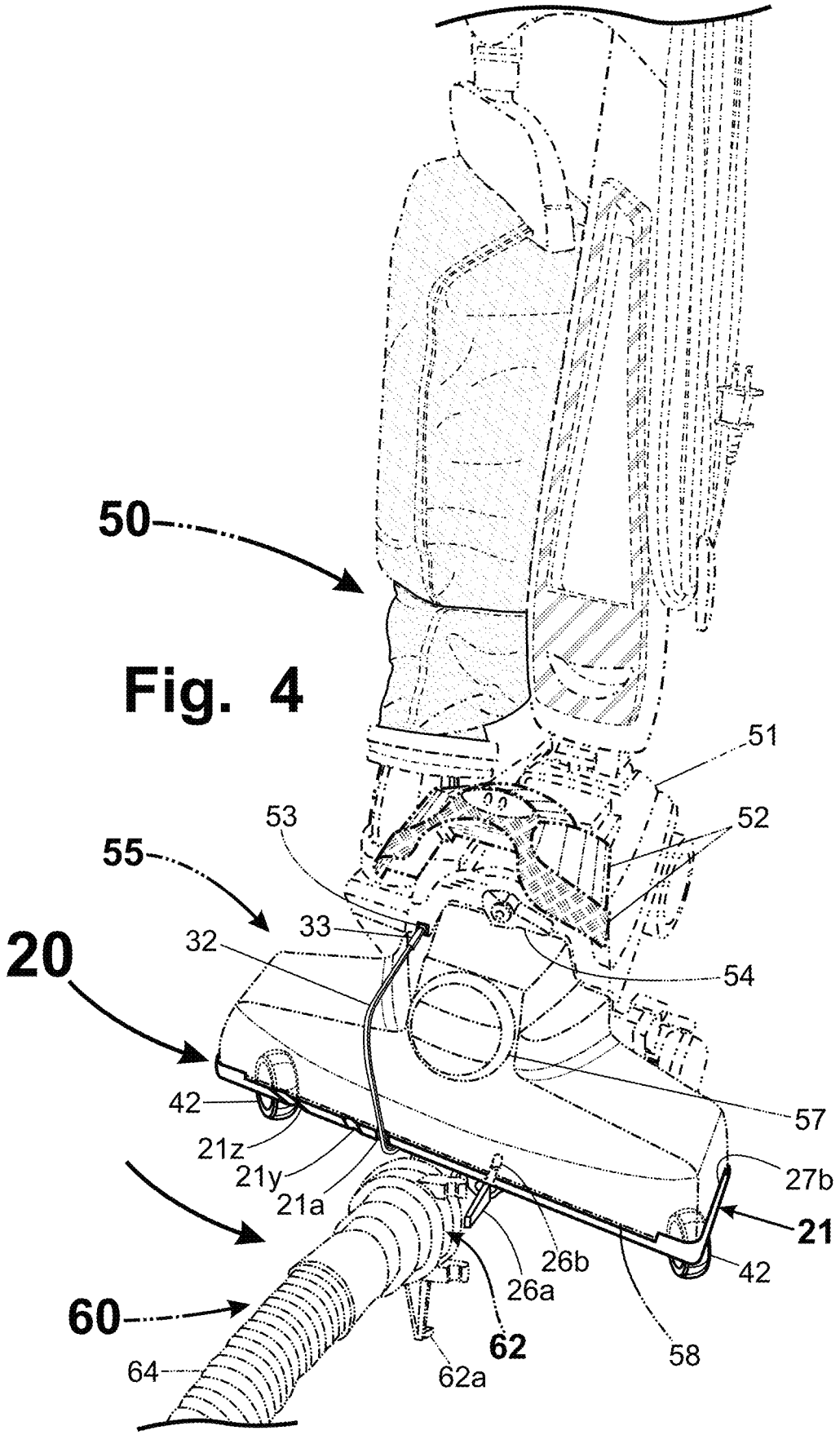
FIG. 4 is a perspective schematic illustration of the disclosed vacuum hose adaptor installed on an upright vacuum with an attached vacuum hose.

FIGS. 1A, and 1B are perspective schematic illustrations of a vacuum hose adaptor 20 (hereafter "hose adaptor 20"). The hose adaptor 20 can comprise an adaptor body 21, a male hose coupler 22, a locking mechanism 26, a pivotal arm assembly 30 and a pair of identical swivel wheel assemblies 40*a* and 40*b* (hereafter "swivel wheel assemblies 40*a* and 40*b*"). In FIGS. 1A and 1B, the hose adaptor 20 is illustrated in a bottom perspective view and a top perspective view respectively. In FIGS. 1A, the pivotal arm assembly 30 is illustrated in a secondary stowed position where the pivotal switch arm 32 (hereafter "pivotal arm 32") can be pivoted against the right side of the adaptor body 21. The shape of the pivotal arm assembly 30 can also allow stowage of the pivotal arm 32 in a primary stowed position 32*z* (hereafter "stowed position 32*z*") to the left (see FIG. 2) by engaging a stowage indent 21*z* (hereafter "indent 21*z*"). The high-speed operational indent 21*a* (hereafter "indent 21*a*") is designed to temporarily secure the pivotal arm 32 in its high-speed operational position as seen in FIGS. 2, 3 and 4. The low-speed operational indent 21*y* (hereafter "indent 21*y*") is designed to temporarily secure the pivotal arm 32 in a low-speed operational position 32*y* (hereafter "low-speed position 32*y*") as seen in FIG. 2. The stowage indent 21*z* is designed to temporarily secure the pivotal arm 32 in the stowed position 32*z* as seen in FIG. 2. In FIG. 1B the pivotal arm 32 is illustrated at a position between the low-speed operational position 32*y* and the stowed position 32*z*. The two stowed positions are made possible due to the shape of pivotal arm 32 the shape of the adaptor body 21. The low-speed position 32*y* places the pivotal arm in free space during operation (i.e., not pressing a high-speed button) so that the vacuum cleaner to which it is attached vacuum operates at a lower speed (i.e., less suction).

In FIGS. 1A and 1B, the male hose coupler 22 is fluidically connected to the adaptor body by a short conduit 23 (hereafter "conduit 23"). The conduit 23 is in fluid communication with a suction air channel 24 within the adaptor body 21 for conducting suction air to the male hose coupler 22 and ultimately to a vacuum cleaner hose 60 (see FIG. 4). The male hose coupler 22 and vacuum cleaner hose 60 (hereafter "vacuum hose 60") can use various prior art connectors and couplers for attaching these two components together (e.g., male and female couplers 22 and 62).

The adaptor body 21 can comprise the indents 21*a*, 21*y*, and 21*z*, the suction air channel 24, a front and back pivot hole 24*a* and 24*b* respectively on each side of the suction air channel 24, a sealing plate 25, a pivotal support 25*a*, a sealing gasket 25*b*, a left and right exterior guide 27*a* and 27*b* respectively (hereafter "exterior guides 27*a-b*"), a left and right attachment bracket 28*a* and 28*b* respectively (hereafter "attachment brackets 28*a-b*") and a left and right internal guide 29*a* and 29*b* respectively (hereafter "interior guides 29*a-b*"). The sealing gasket 25*b* can be bonded to the top surface of the sealing plate 25 and extends around the sealing plate 25 along its upper surface (i.e., sealing surface). The sealing gasket 25*b* can comprise nearly any compliant material, including but not limited to, TPR, TPU, foam rubber, rubber, various foam elastomers, various elastomers, etc. The exterior guides 27*a-b*, attachment brackets 28*a-b* and interior guides 29*a-b* can all be designed to interact with the lower portion of a vacuum cleaner main nozzle 55 to help guide the hose adaptor 20 in place for use (see FIG. 4). The internal locking mechanism 26 can comprise an actuator tab 26*a* and a locking pin 26*b* which can extend through the pivotal support 25*a* to allow the locking pin 26*b* to engage the inside surface of the vacuum cleaner main nozzle 55 (hereafter "main nozzle 55") of an upright vacuum cleaner 50 (hereafter "vacuum cleaner 50"). The main nozzle 55 comprises a bottom plate 58 that can act as a guard for a rotary brush within the main nozzle. The swivel wheel assemblies 40*a* and 40*b* can each comprise a wheel 42, a swivel bearing 44 and a swivel plate 46. The swivel plate 46 of each swivel wheel assembly 40*a* and 40*b* is attached on the left and right portions of the underside of the adaptor body 21.

In FIGS. 1A, 1B and 3, we see that the pivotal arm assembly 30 can comprise the pivotal arm 32 previously mentioned, a soft tip 33 on the end of the pivotal arm 32, a back stop 34*a*, a front stop 34*b* and an optional friction device 36 (hereafter "friction block 36"). The pivotal arm 32 can be made from various high-strength and impact resistant material, including but not limited to, a heavy gage stainless steel wire, a piano wire, an alloy wire, a polymer, a composite or nearly any other high-strength material. The soft tip 33 can be mounted at the exposed end of the pivotal arm 32 to prevent scratching of the vacuum's surface during mounting and dismounting of the hose adaptor 20. The soft tip 33 can be made of nearly any soft plastic, such as but not limited to, nylon, polypropylene, polyester and various elastomers. The soft tip 33 may also comprise an elastomer, such as but not limited to, natural rubber, TPEs (thermal plastic elastomers), TPRs (thermal plastic rubbers) and TPUs (thermal plastic urethanes). The pivotal arm 32 can comprise three distinct sections, a pivotal axis section 32*a*, a contact section 32*b* and an extended section 32*c*. The pivotal axis section 32*a* can be designed to fit through the pivot holes 24*a-b* to provide a hinge support for the pivotal arm 32 to rotate about. The back stop 34*a* (hereafter "stop 34*a*") and front stop 34*b* (hereafter "stop 34*b*") can prevent the pivotal axis section 32*a* of pivotal arm 32 from sliding back and forth within the holes 24*a-b* and thus maintain the proper position of the pivotal axis section 32*a* with respect to the adaptor body 21. With the pivotal axis section 32*a* having a stable position (i.e., with stops 34*a-b*) the contact axis section 32*b* can provide friction contact against the front surface of the adaptor body 21 and can have secure stops when engaging the indents 21*a*, 21*y* and 21*z*. This provides secure holding positions for the pivotal arm 32 that can temporarily hold the pivotal arm 32 at the proper orientation depending on the desired function. The indents 21*a*, 21*y* and 21*z* are illustrated here as notches in the front surface of the adaptor body 21, but can comprise nearly any other temporary latching system that can temporarily position the pivotal arm 32 respectively in its high-speed operational position (see FIGS. 2, 3 and 4), its low-speed position 32*y* (see FIG. 2) and/or its stowed position 32*z* (see FIGS. 1B and 2). The indents 21*a*, 21*y* and 21*z* are optional, but can make the vacuum hose adaptor 20 easier to install and operate by the user. The optional friction block 36 can be positioned against the pivotal axis section 32*a* to provide friction to allow the user to position the pivotal arm 32 in any location between the stowed position 32*z* and its high-speed operational position seen in FIGS. 2, 3 and 4). In some embodiments the friction block 36 can replace the need for the need for the indents 21*a*, 21*y* and 21*z*. In other embodiments, the indents 21*a*, 21*y* and 21*z* can be omitted and simply friction of the contact section 32*b* against the front surface of the adaptor body 21 can be sufficient to hold the pivotal arm in place during installation, use, and stowage. In some embodiments, only the high-speed operational indent 21*a* can be used to provide the proper position of the pivotal arm 32 for installing the vacuum hose adaptor 20 on a upright vacuum (e.g., the upright vacuum cleaner 50 in FIG. 4).

As seen in FIGS. 1A, 2 and 4, the locking mechanism 26 can be mounted through the pivotal support 25*a* to provide a secure pivotal mounting structure for both the actuator tab 26*a* and the locking pin 26*b*. The actuator tab 26*a* is securely attached to the locking pin 26*b* so that the two rotate as one. In this way, rotation of the actuator tab 26*a* by the user causes the locking pin 26*b* to also rotate and securely lock the vacuum hose adaptor 20 temporarily to the bottom of the upright vacuum cleaner 50 (see FIG. 4). The actuator tab 26*a* can include a rubberized cover to provide a soft surface for the user press against when locking and unlocking the locking pin 26*b* from the vacuum cleaner 50. FIG. 4 illustrates the locking pin 26*b* (in shadow lines) locked in place behind the bottom plate 58. In some embodiments, two or more locking mechanisms 26 can be used. For example, one locking mechanism 26 on the right of male hose coupler 22 as shown, and another similar locking mechanism 26 mounted on the left of the male hose coupler 22. This can enhance the stability of the attachment of the hose adaptor 20 to the vacuum cleaner 50 when rolling on the floor (i.e., when being used, see FIG. 4). Also, the exterior guides 27*a-b* and/or the interior guides 29*a-b*, if used, can further prevent the hose adaptor 20 from slipping around from forces caused by pulling on the attached vacuum hose 60 from various directions.

The swivel wheel assemblies 40*a* and 40*b* can comprise prior art swivel wheels that can be mounted to the bottom of the adaptor body 21 with the swivel plate 46 at a lean angle 49. The lean angle 49 is selected to orient the axis of rotation for the swivel bearing 44 to be substantially vertical during operation. That is, when the hose adaptor 20 is installed on the vacuum cleaner 50 the height of swivel wheel assemblies 40*a* and 40*b* cause the vacuum cleaner 50 to be angled up in the front, which causes the adaptor body 21 to also angle back by the lean angle 49. Thus, the lean angle 49 orient the swivel plate 46 substantially horizontally during operation and can allow the swivel wheel assemblies 40*a* and 40*b* to swivel in every direction equally well (i.e., to provide optimal operation of the swivel wheel assemblies 40*a-b*). The sealing plate 25 can be locked against the bottom plate 58 (see FIG. 4) with the locking mechanism 26 (see FIGS. 1A-B, 2 and 4). With the sealing plate 25 locked against the bottom plate 58, the suction air from the vacuum cleaner 50 can be conducted to the male hose coupler 22 (see FIG. 1A through 3) and into any attached vacuum hose 60. Note that FIG. 3 does not show the hose adaptor 20 in its operational orientation. The illustration in FIG. 3 needs to be rotated counter-clockwise by the lean angle 49 to place it in its operational orientation where swivel plate 46 is substantially horizontal (i.e., normal to the ground) and the rotational axis of the swivel bearing 44 is substantially vertical.

In FIG. 3, illustrates a side view of the hose adaptor 20 with the pivotal arm 32 in its high-speed operational position when attached to vacuum cleaner 50 (see FIG. 4). Notice the lean angle 49 on the swivel wheel assembly 40*a* (swivel wheel 40*b* hidden behind swivel wheel assembly 40*a*). Not all hidden lines are illustrated in this figure to keep the drawing less cluttered and to focus on the swivel wheel assembly 40*a* and pivotal arm assembly 30. The straight pivotal axis section 32*a* can be seen passing through pivot holes 24*a-b* in the suction air channel 24. The stops 34*a* and 34*b* prevent the pivotal arm 32 from sliding either left or right and only allows it to pivot. The stops 34*a* and 34*b* can comprise washers, c-clips or other retaining devices. In this example, the stops 34*a-b* comprise a washer with a retaining clip secured in a groove in the pivotal axis section 32*a*. This is a common practice for many shafts that need to rotate while also maintaining its axial position against axial forces.

FIG. 4 is a perspective schematic illustration of the disclosed vacuum hose adaptor 20 installed on the vacuum cleaner 50 with the vacuum hose 60 attached to the male hose coupler 22. The vacuum cleaner 50 can comprise a main body 51, a headlight cap assembly 52, the main nozzle 55, a high-speed switch 53, a clamp 54, a belt lifter 57 and the bottom plate 58. The vacuum hose 60 can comprise a female hose coupler 62, and activator arm 62*a* and a vacuum hose conduit 64 (i.e., a flexible vacuum hose). The female hose coupler 62 can be designed to removably attach to the male hose coupler 22 so that suction air can be communicated to the vacuum hose conduit 64 (hereafter "flexible conduit 64"). The basic vacuum cleaner design illustrated in FIG. 4, has been made since 1991, but the disclosed hose adaptor 20 can be modified to fit other vacuum cleaners as well. The main nozzle 55 includes the belt lifter 57 and can be removed from the main body 51 by disengaging the clamp 54. In this way, the main nozzle 55 can be removed and the vacuum hose 60 can be attached directly to the main body 51 for use. However, this takes many steps and requires lifting the relatively bulky main nozzle 55 and storing it somewhere. The vacuum cleaner 50 and attached vacuum hose 60 are illustrated in shadow lines to illustrate that it is prior art. Note that hidden lines for most of the hose adaptor 20 are not shown to prevent cluttering of the drawing. Only the hidden lines for wheels 42 are shown in this figure to reduce clutter and assist in understanding the illustration. The wheels 42 raise the female hose coupler 62 above the floor such that even if the activator arm 62*a* is installed downward on the male hose coupler 22 in this example to illustrate that the swivel wheels can raise the female hose coupler 62 far enough above the floor so that the activator arm 62*a* will not contact the floor even when connected pointing straight toward the floor as illustrated in FIG. 4. The high-speed switch 53 allows the selection of running a vacuum motor within the vacuum cleaner 50 at a low-speed (lower suction) for cleaning carpets when not depressed, and at a high-speed (i.e., large suction) for using the vacuum hose 60 with various prior art tools when the high-speed switch 53 is depressed. With the main nozzle 55 attached to the vacuum cleaner 50, the high-speed switch 53 is exposed to the outside and is not engaged which results in the vacuum cleaner 50 operating at the low-speed. When the hose adaptor 20 is installed, with the pivotal arm 32 in its high-speed position, as shown in FIG. 4, the soft tip 33 on the pivotal arm 32 can press the high-speed switch 53 which increases the vacuum cleaner's 50 suction power by sending more electrical power to the vacuum cleaner 50. This is possible because the pivotal arm 32 is shaped in such a way that it presses the high-speed switch 53 when installed on the bottom of the main nozzle 55. Once the vacuum attachment 20 is secured to the main nozzle 55, suction air can find a continuous passageway through the main nozzle 55, sealing plate 25, suction air channel 24, air passageway 23, male hose coupler 22, female hose coupler 62 and flexible conduit 64.

OPERATIONAL DESCRIPTION

Before use, the hose adaptor 20 is slid under the main nozzle 55 with left and right exterior guides 27*a-b* assisting in guiding the attachment brackets 28*a-b* to the interior back side of the bottom plate 58. The attachment brackets 28*a-b* can engage the interior back side of the main nozzle 55 so that the back portion of the sealing plate 25 is held against the bottom plate 58. The weight of the vacuum cleaner 50 can then press the front portions of the sealing plate 25 and bottom plate 58 together which can place the locking mechanism 26 in the proper position for engaging the interior front portion of the main nozzle 55 and/or bottom plate 58. Once attached, the sealing plate 25 lays flush against the bottom plate 58 (see FIG. 4) of vacuum cleaner 50, and if sealing gasket 25*b* is present it is pressed between the sealing plate 25 and bottom plate 58 to form a substantially airtight seal. The exterior guides 27*a-b* and interior guides 29*a-b* interact with the exterior and interior of the main nozzle 55 and bottom plate 58 respectively, and can guide the hose adaptor 20 into place under the bottom plate 58. The left and right attachment brackets 28*a-b* can engage the back portion of the bottom plate 58 or main nozzle 55 to secure the back portion of the sealing plate 25 against the bottom plate 58. Then the locking mechanism 26 can be engaged by the user, by pressing on the actuator tab 26*a* to pivot the locking pin above the bottom plate 58 internally to secure the front portion of the hose adaptor 20 to the main nozzle 55 and vacuum cleaner 50. The vacuum hose 60 can be already connected to the hose adaptor 20 at male hose coupler 22 before the hose adaptor 20 is attached to the bottom of the main nozzle 55 (i.e., vacuum cleaner 50). In other operational modes the vacuum hose 60 can be attached to the male hose adaptor 22 after the hose adaptor 20 has been attached to the vacuum cleaner 50. Leaving the vacuum hose 60 attached to the hose adaptor 20 when not in use can save time both when re-attaching the vacuum hose 60 to the vacuum cleaner 50 and also when switching back to an upright carpet cleaning mode. In some embodiments, the sealing plate 25 may also comprise a sealing gasket 25*b* on its top surface to improve the efficiency at which suction air is conducted into the male hose coupler 22 from the vacuum cleaner 50.

The attachment process can go as follows: (A) attach the vacuum hose to the male hose coupler 22 (note that the vacuum hose 60 may already be attached to the male hose coupler 22 to save this step when installing the hose adaptor 20), (B) pivot the pivotal arm 32 into its selected position either low-speed (i.e., indent 21*y*) or high-speed (i.e., indent 21*a*), (C) lift the front end of the vacuum cleaner 50 slightly so that the main nozzle 55 is raised above the floor, (D) insert the back portion of the sealing plate 25 under the main nozzle 55 and allowing the exterior guides 27*a-b* to engage the exterior sides of the main nozzle 55 and the interior guides 29*a-b* to engage the interior edges (not seen) of the main nozzle 55 to guide the sealing plate into position, (E) continue sliding the sealing plate under the main nozzle 55 until the attachment brackets 28*a-b* slide over the back inner edge of the bottom plate 58 and lock in place, (F) press the sealing plate 25 against the bottom plate 58, and then (G) press the actuator tab 26*a* to the left to rotate the locking pin 26*b* against the front underside of the bottom plate 58. This process locks the hose adaptor 20 to the bottom of the main nozzle 55 and allows the vacuum hose 60 to pull the vacuum cleaner 50 around while cleaning. Other embodiments of the claimed invention may include the use of more than one actuator tab.

To remove the hose adaptor 20 from the vacuum cleaner 50, the actuator tab 26*a* can be rotated to the right which disengages the locking pin 26*b* from the underside of the bottom plate 58. This releases the locking mechanism 26 from the bottom plate 58 of the main nozzle 55 and the hose adaptor 20 can then be easily slid out from under the bottom plate 58. Once removed, the pivotal arm 32 can be pivoted down against the sealing plate 25 and snapped in place within optional indent 21*z*. The pivotal arm 32 can pivot because of the pivot holes 24*a-b* which interact with the straight pivotal axis section 32*a* of pivotal arm 32 and form a hinge. The vacuum hose 60 can be left attached to the hose adaptor 20 for storage until the next time the vacuum hose 60 is needed. Leaving the vacuum hose 60 attached can save time and effort in two ways. First, the step of attaching and detaching the vacuum hose 60 to and from the hose adaptor 20 is eliminated. Second, because the female hose coupler 62 makes a good gripping handle, having the female hose coupler 62 attached can make it easier to install the hose adaptor 20 under the main nozzle 55.

During operation of the vacuum hose 60 the vacuum cleaner 50 can be pulled around by pulling on the flexible conduit 64. The two swivel wheels 42 can be spaced as wide apart as practical including being flush with the outer portion of the adaptor body 21 to provide a very stable support system for the front of the vacuum cleaner 50. As the vacuum cleaner 50 is rolled around, the swivel wheels 42 can easily swivel to change direction and make it easy for the vacuum cleaner 50 to swivel and roll in any direction.

Many components of the disclosed vacuum hose adaptor systems can be modified to optimize their operation. For example, in some embodiments the exterior guides 27*a* and 27*b* and interior guides 29*a* and 29*b* can all be omitted from the hose adaptor 20 and allow only the attachment brackets to help guide the hose adaptor into place. In other embodiments, only the exterior guides 27*a-b* can be used. In other embodiments, the exterior guides 27*a-b* can be located at a higher portion in the back (i.e., away from the male hose coupler 22) to provide better contact with the sides of the main nozzle 55 to better guide the hose adaptor 20 into place for use. In other embodiments, a friction contact between the pivotal arm 32 and the adaptor body 21 is used without indents.

Therefore, the disclosed systems and methods are well adapted to attain the ends and advantages mentioned as well as those that are inherent therein. The specific dimensions shown are to assist the readers in understanding of the vacuum hose adaptor structure, but should not be used to limit the scope of a particular vacuum hose adaptor structure. The particular embodiments disclosed herein are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the illustrative embodiments disclosed above may be altered, combined or modified and all such variations are considered within the scope of the present disclosure. The systems and methods illustratively disclosed herein may suitably be practiced in the absence of any element that is not specifically disclosed herein and/or any optional element disclosed herein. While systems and methods are described in terms of "comprising," "containing," or "including" various components or steps, the systems and methods can also "consist essentially of" or "consist of" the various components and steps. All numbers and ranges disclosed above may vary by some amount. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A vacuum hose adaptor for removable attachment to a main nozzle of a vacuum cleaner, comprising:

an adaptor body, comprising a front, a back, a top and a bottom, wherein a suction air channel and a sealing plate are defined on the top of the adaptor body;

a vacuum hose coupler attached to the front of the adaptor body and in suction communication with the suction air channel and configured to be removably attached to a flexible vacuum hose;

a pair of swivel wheels that are attached to the bottom of the adaptor body at an angle with respect to the sealing plate;

a locking mechanism configured to engage a main nozzle of a vacuum cleaner during use to removably secure the front of the adaptor body against the main nozzle; wherein suction air can be communicated between the main nozzle and the suction air channel during use of the vacuum cleaner, and a pivotal arm assembly comprising a pivotal arm with a tip; wherein the pivotal arm is configured to be movable between a stowed position and a high-speed position, wherein the tip is configured to engage a high-speed switch on the vacuum cleaner when the pivotal arm is in the high-speed position.

2. The vacuum hose adaptor of claim 1, wherein the adaptor body comprises a left side with a left guide and a right side with a right guide, wherein the left and right guides extend above the sealing plate and are configured to engage a left and right side of the main nozzle respectively.

3. The vacuum hose adaptor of claim 1, wherein the sealing plate comprises a gasket bonded to the sealing plate, wherein the gasket is configured on the sealing plate to form a seal between the sealing plate and the main nozzle of the vacuum cleaner.

4. The vacuum hose adaptor of claim 1, wherein the locking mechanism comprises:

one or more attachment bracket at the back of the adaptor body configured to engage a back portion of the main nozzle; and one or more locking pins at a front portion of the adaptor body configured to removably secure the front portion of the adaptor body to a front portion of the main nozzle.

5. The vacuum hose adaptor of claim 1, wherein the adaptor body comprises a stowed indent that is configured to engage the pivotal arm when in the stowed position.

6. The vacuum hose adaptor of claim 1, wherein the adaptor body comprises a high-speed indent that is configured to engage the pivotal arm when in the high-speed position.

7. The vacuum hose adaptor of claim 1, wherein the pivotal arm is further configured to include a low-speed position.

8. The vacuum hose adaptor of claim 7, wherein the adaptor comprises a low-speed indent that is configured to engage the pivotal arm when in the low-speed position.

9. A vacuum hose adaptor for removable attachment to a main nozzle of a vacuum cleaner, comprising:

an adaptor body, comprising a front, a back, a top, a bottom, a left guide and a right guide, wherein a suction air channel and a sealing plate are defined on the top of the adaptor body and the left and right guides extend above the sealing plate and are configured to engage the main nozzle;

a vacuum hose coupler attached to the front of the adaptor body and in suction communication with the suction air channel and configured to be removably attached to a flexible vacuum hose;

a pair of swivel wheels that are attached to the bottom of the adaptor body at an angle with respect to the sealing plate;

a locking mechanism configured to engage a main nozzle of a vacuum cleaner during use to removably secure the front of the adaptor body against the main nozzle; wherein suction air can be communicated between the main nozzle and the suction air channel during use of the vacuum cleaner, and a pivotal arm assembly comprising a pivotal arm with a tip; wherein the pivotal arm is configured to be movable between a stowed position and a high-speed position, wherein the adaptor body comprises a stowed indent that is configured to engage the pivotal arm when in the stowed position.

10. The vacuum hose adaptor of claim 9, wherein the adaptor body comprises a high-speed operational indent that is configured to engage the pivotal arm when in the high-speed position.

11. The vacuum hose adaptor of claim 9, wherein the pivotal arm is further configured to include a low-speed position.

12. The vacuum hose adaptor of claim 11, wherein the adaptor comprises a low-speed indent that is configured to engage the pivotal arm when in the low-speed position.

13. The vacuum hose adaptor of claim 9, wherein the sealing plate comprises a gasket bonded to the sealing plate, wherein the gasket is configured on the sealing plate to form a seal between the sealing plate and the main nozzle of the vacuum cleaner.

14. The vacuum hose adaptor of claim 9, wherein the locking mechanism comprises:

one or more attachment bracket at the back of the adaptor body configured to engage with a back portion of the main nozzle; and one or more locking pins at a front portion of the adaptor body configured to removably secure the front portion of the adaptor body to a front portion of the main nozzle.

15. The vacuum hose adaptor of claim 9 wherein the tip is configured to engage a high-speed switch on the vacuum cleaner when the pivotal arm is in the high-speed position.

16. The vacuum hose adaptor of claim 9 further comprising a friction block configured to allow the pivotal arm to be positioned in any location between the stowed position and the high-speed position.

* * * * *